United States Patent [19]

Rudell

[11] Patent Number: 4,684,127

[45] Date of Patent: Aug. 4, 1987

[54] GAME WITH TETHER STRAPS

[76] Inventor: Elliot A. Rudell, 2215 237th St., Torrance, Calif. 90501

[21] Appl. No.: 22,758

[22] Filed: Mar. 6, 1987

[51] Int. Cl.[4] ..... A63F 9/00

[52] U.S. Cl. ..... 273/1 G

[58] Field of Search ..... 273/1 G, 1 GC, 1 GD

[56] References Cited

U.S. PATENT DOCUMENTS

| | | | |
|---|---|---|---|
| 3,480,275 | 11/1969 | Jernstrom et al. | 273/1 G |
| 3,533,622 | 10/1970 | Foley et al. | 273/1 G |
| 3,652,087 | 3/1972 | Carmen | 273/1 G |
| 4,039,186 | 8/1977 | Anderson | 273/1 G |
| 4,124,207 | 11/1978 | Breslow et al. | 273/1 G |
| 4,315,628 | 2/1982 | Balash et al. | 273/1 G X |

*Primary Examiner*—Paul E. Shapiro

*Attorney, Agent, or Firm*—Plante, Strauss & Vanderburgh

[57] ABSTRACT

There is disclosed a game for four or more players whereby the players are attached together by removably attached tethers, and then required to perform physical movements and maintain their attached relationships one to another. The tether straps provide a yielding restraint and the game challenges the players to perform certain physical movements without breaking this restraint.

25 Claims, 6 Drawing Figures

GAME WITH TETHER STRAPS

BACKGROUND OF THE INVENTION

1. Field of the Invention

The invention relates to activity games, and more particularly to a game wherein the players actively participate in the play using their bodies and physically reacting to particular commands.

2. Description of the Prior Art

As used herein, a game is defined as any specific amusement or sport involving physical or mental competition under specific rules. A toy, by comparison, is an article to play with, especially a plaything for children.

Action games wherein people actively participate with their bodies are well known. The most popular of these games, called "Twister" by Milton Bradley Company, requires one or two players, at a time, to touch colored circles on a large vinyl mat in response to color commands of a spinner. Another classic game requires a blindfolded player to locate or attach a removable object, such as an element looking like a donkey's tale, to a particular position on a poster, perhaps looking like a donkey.

To my knowledge, it has never been known to use removably attached tethers to hold two or more people together while they work in unison to obey commands given by an opponent in a game played by specific rules.

A toy that contains a handcuff to attach a child to an inanimate stuffed monster utilizes Velcro to hold the handcuff loops in place, but no game is allowed for or implied. No competitive action between a plurality of players is expressed or implied. The Velcro in this toy is neither designed nor limited to allow for very sensitive removal by a gentle pulling force.

SUMMARY OF THE INVENTION

This invention is a game which is played by at least four players who are positioned in an assembly facing each other and who are interconnected by tethers. The tethers distally bear limb grasping means and are from 10 to about 30 inches long, and are attached between the limbs of each of the players. The tethers restrain and constrain the movement of participants in a game.

The game is played by randomly selecting and sequentially giving manipulation commands to selected players which require the selected players to establish and maintain contact with a designated point of a player and by keeping the score of successfully executed commands. A command is successfully executed when it is performed without breaking prior contacts and without breaking the attachment of any tether, and without any player falling to the ground.

DESCRIPTION OF THE PREFERRED EMBODIMENTS

Figure 1:
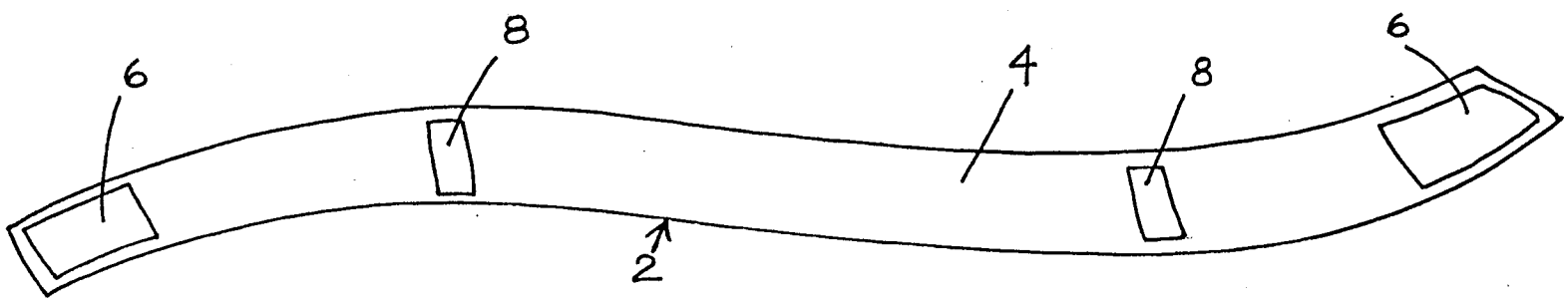
FIG. 1 illustrates a typical tether device employed in the game of this invention.

FIG. 1 illustrates a preferred tether design. Tether 2 is constructed of a strip 4 of a durable, flexible material such as vinyl, cloth-back vinyl or equivalent. This allows tether 2 to flex and twist compliantly, yet maintain its length and structural integrity. Tether 2 can be 24 inches long and 1 inch wide, or any comparable strip proportion. The tether distally carries attachment means permitting it to be yieldingly secured to a limb of a player. For this purpose, tabs 6 and 8 are attached at each end of the tether, with tabs 6 being at the extreme ends of the tether and tabs 8 being spaced apart from tabs 6 by a slight distance, sufficient to permit the end of the tether to be wrapped about a limb and attached to itself by fastening tabs 6 against tabs 8.

The tabs 6 and 8 are formed of a material typically called Velcro. This material attaches to itself by its well-known design of fabric hook pieces gripping onto fabric loop pieces. In this embodiment, tabs 6 are of the loop Velcro design and can be $\frac{1}{2}$ inches long by $\frac{5}{8}$ inches wide. Tabs 8 are of the hook Velcro design and can be $\frac{1}{2}$ inch long by $\frac{5}{8}$ inches wide. This size has been found to provide the optimum degree of yielding restraint, as it permits children of 6 years or more, to apply sufficient force to overcome the attachment and release their limbs. Accordingly, a degree of skill or care thus becomes involved in that a player must attempt to carry out a command, without using such force that release the restraining tether.

The size and configuration of each of the Velcro tabs in this invention can vary, except that tab 6 on either end of tether 4 and tab 8 on the same tether 4 should be of opposite material, either hook or loop, so as to insure compatibility. The Velcro tabs 6 and 8 are all fixably attached to strip 4 by either non-removable adhesive or by stitching.

Figure 2:
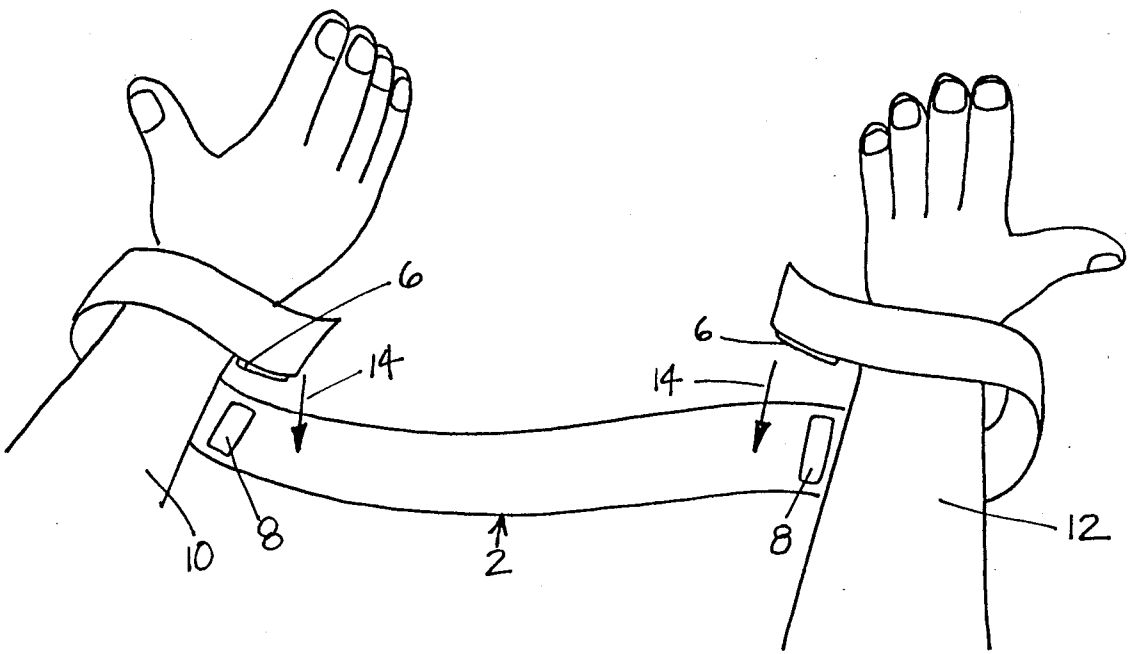
FIG. 2 illustrates how the tether device is used to attach two players together.

FIG. 2 illustrates how tether 2 is employed to attach two game players together. Each player extends one opposite arm, in this illustration depicted as player A's right arm 10 and player B's left arm 12. Tether 2 is positioned above each player's hand and then looped around both wrists so that tabs 6 and 8 on each end of the tether 2 can make contact with each other and thereby grip together, holding tether 2 in place on each wrist and thereby tethering the two players together. Arrows 14 depict the direction of movement of each tab 6 to meet and interact with its respective tab 8.

Figure 3:
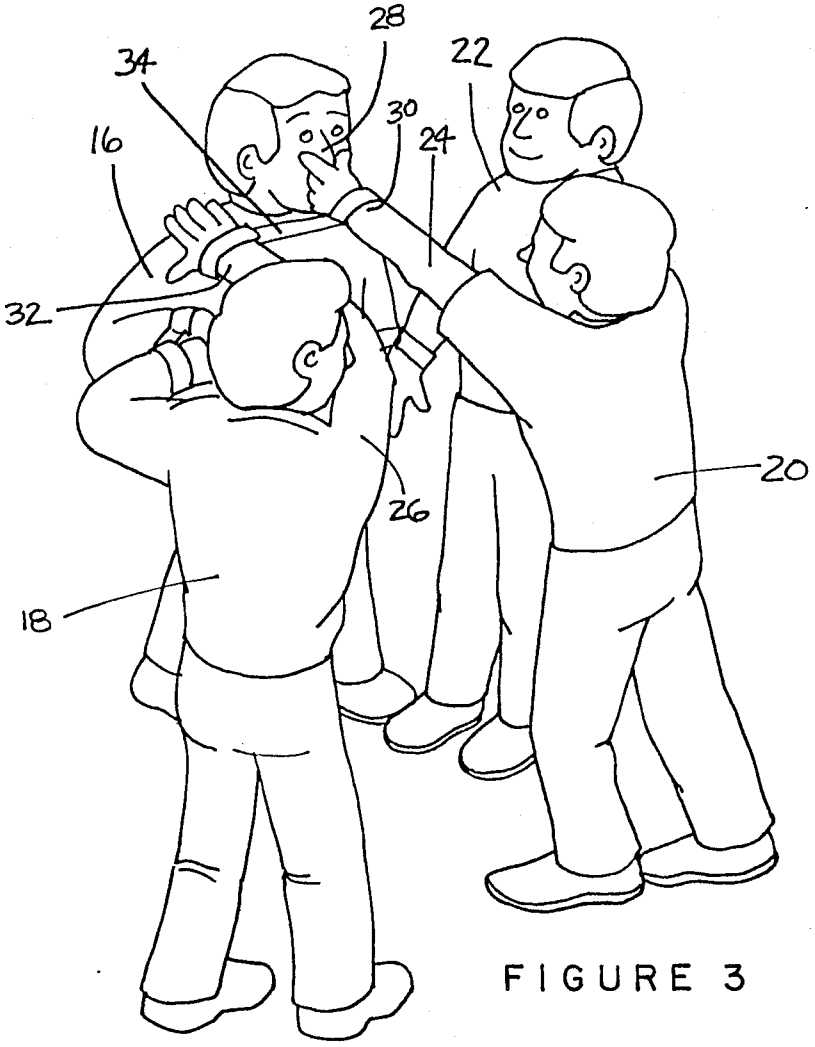
FIG. 3 illustrates a typical first move of the game wherein the tether device restricts player movement.

FIG. 3 depicts four players 16, 18, 20, and 22 standing in inter-related positions, one to another, and restrained together by tethers on all wrists, each tether as described in FIG. 2. An operational example of game play and tether restraining action of the invention can be described by looking at the players in this drawing. Player 20 has his left arm 24 outstretched to touch the nose 28 of player 16. Tether 34 is removably attached around the left wrist 30 of player 20 and the right wrist 32 of player 18. It is therefore necessary for player 18 to cooperate by moving his right arm 26 in a direction so as to allow player 20 to touch the nose of player 16. If player 18 would not move his arm 26, it is possible that player 20 either could not touch nose 28, or else it is possible that the force applied to tether 34 would be sufficient to cause the Velcro tabs, as described in FIG. 2, to separate, releasing the players's wrist.

It is understandable by this drawing that all players are similarly tethered together as described, and that numerous commands to touch other players's body parts would require extensive body movement and cooperation to maintain, in place, all tethers.

Figure 4:
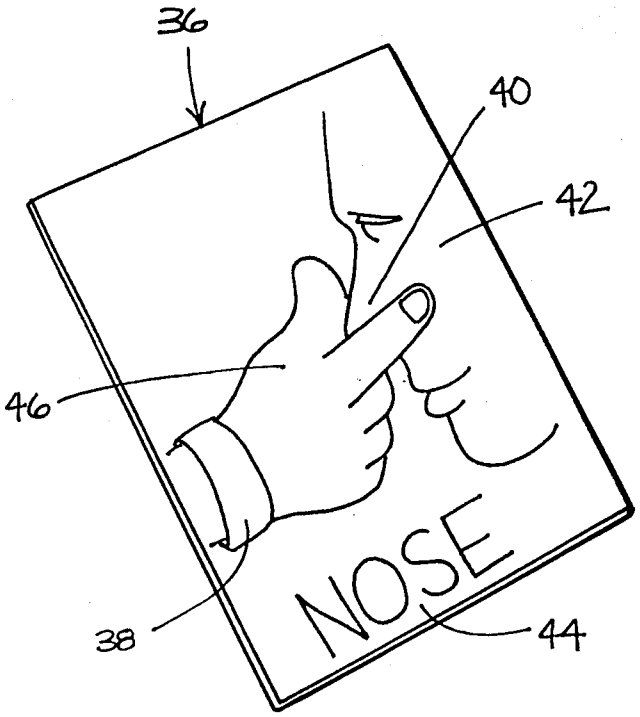
FIG. 4 illustrates a card that could be employed to determine the play action.

In FIG. 4, a game card 36 of paper or similar material is shown whereon is depicted a particular play in the game of the invention. A plurality of these cards, typically arranged in a deck of such cards, is used in the game. The game is played by randomly selecting one of the plurality of game cards, each of which contains a single manipulation command. In the typical application, the deck of games cards is shuffled to arrange the cards in a random order, and the play begins by selecting the top card from the deck.

Game card 36 shows a face 42 with nose 40 being held by hand 46. Looped around the wrist of hand 46 is a tether 38. The word "nose" 44 is written at the bottom of the game card. This game card thus contains the command for a tethered player to touch the nose of a player in the circle. Entirely graphic commands, entirely written commands, or combinations of both graphic and written commands, such as shown on game card 36, can be used.

Figure 5:
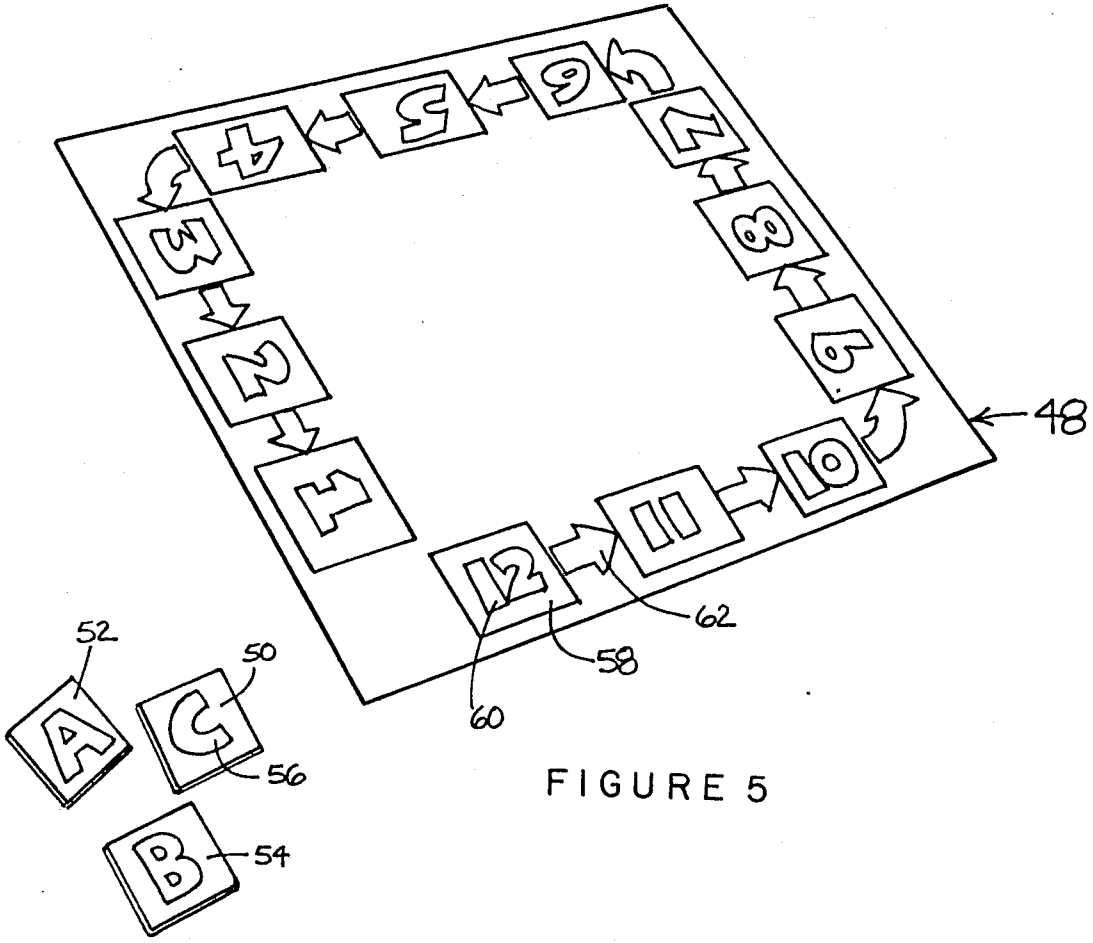
FIG. 5 illustrates a scoring mat that could be used to tally each player's score.

FIG. 5 shows a score mat 48 that can be placed on the floor near the players. It can be constructed on a vinyl sheet, approximately 0.010 inch thick. It can be graphically decorated by silk screening or similar process, and can have a plurality of boxes, such as 58, wherein a number such as 60, can be printed. Arrows such as 62 can be displayed to assist players in scoring direction. Each player can have a token, such as 50, 52, and 54, whereon a different letter or color is printed to discriminate one player's token from the other. Token 50, for example, has indica 56, which is the letter C.

Figure 6:
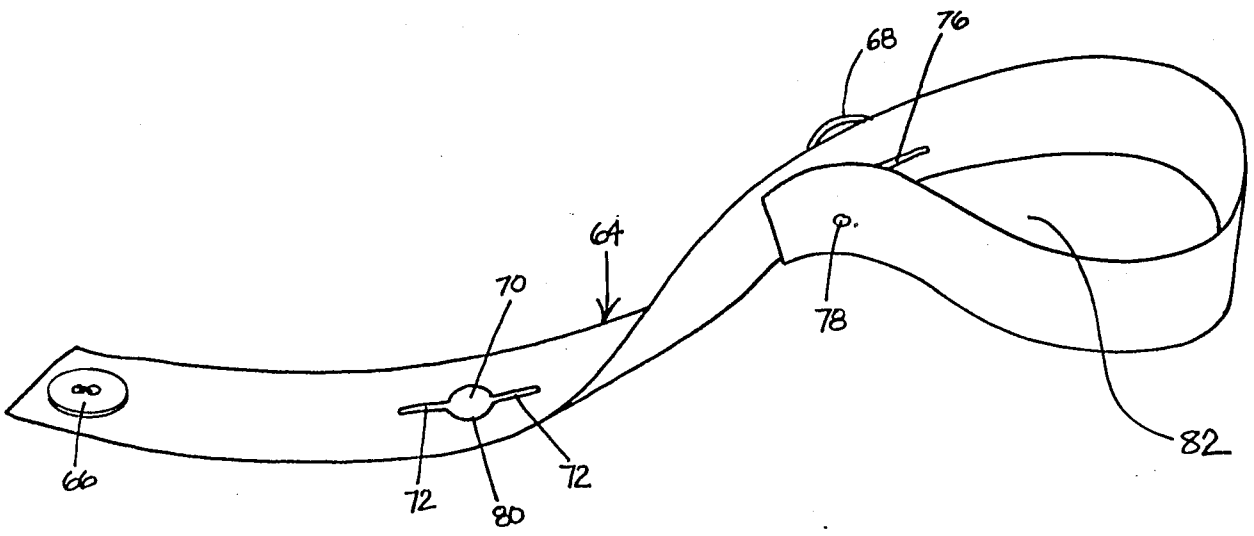
FIG. 6 illustrates an alternative tether design.

FIG. 6 depicts an alternative design to the tether of FIG. 1. Tether 64 can be comprised of cloth or vinyl or similar material, and can be of similar dimensions to tether 2 of FIG. 1. Buttons 66 and 68 are stitched to tether 64. Thread through the tether affixing button 68 is shown as dot 78. Orifices 70 and 76 are die-cut into the tether, and can be shaped as slit 72 with small hole 80 in its midst. Looking now at button 68 pushed through orifice 76 to create loop 82, it can be clearly understood that this alternative design, as well as other alternatives such as metal snaps, could be employed to restrain players together while providing a release action upon the exertion of pull force upon the tether. Another alternative tether could be injection molded plastic links with Velcro tabs on end sections.

EXAMPLE

The game is illustrated by the following specific application. The game is intended for use by four to six players, ages 6 to adult.

The object of the game is to score the most points by tangling up the other players, i.e., to limit or impede their abilities to carry out commands. The equipment which is used for a game comprises the following:

5 bracelets
16 game cards
6 score tokens
1 score mat

To start the game, the score mat 48 is placed on the ground a safe distance away from the players.

Each player takes a different color score token 50. He can place it in his pocket, or he can put it in the center of the score mat 48.

One player takes the game cards 36 and places them in any order he wants. During the next round, he'll be in the circle with the other players, and a different player will be holding the game cards 36.

The other players stand in a circle facing each other. They use the bracelets 2 to attach themselves, by their wrists, to the wrists of the two players on either side of them.

The player outside the circle picks a game card 36 and calls out its command, which one player must obey by touching, and continuing to hold onto, a point of someone else's body with one of this hands, e.g., he calls out, "Joey, touch Emily's wrist."

Joey must then reach out with either hand, touch Emily's wrist, and continue holding onto it. If one of Joey's hands was already holding onto someone else from an earlier command, Joey would have to use his other hand to obey the command.

After a player in the circle successfully obeys a command of a game card 36, the player outside the circle takes the card 36 that was just obeyed and puts it on the score mat 48. He places the first obeyed card in box 58 having the score of "12", and the second obeyed card in the succeeding "11" box, and so on.

The players in the circle must remain standing throughout the round. They cannot sit, kneel, or fall down. Knees cannot touch the ground.

The round is over whenever:

a. One of the bracelets pulls apart;
b. Any of the players fall; or
c. Any player in the circle lets go of another player (except to obey an additional command).
d. a player fails to execute a given command; or
e. upon exhaustion of all the game cards in the deck of cards.

The player outside the circle places his own colored score token 50 in the first box on the score mat 48 that does not have a game card 36 on it.

All game cards 36, those on the score mat 48 and those unused by the last player outside the circle, are then reshuffled and given to the next player who will. call out the cards for the next round.

I claim:

1. A game method which comprises the steps of:

a. selecting at least four players;
b. arranging the players in an assembly facing each other;
c. interconnecting a limb of each player to an adjacent players by attaching tethers, which distally bear limb grasping means and which are from 10 to about 30 inches long, between the limbs of each of the players;
d. randomly selecting and sequentially giving manipulation commands to selected players which require the selected players to establish and maintain contact with a designated point of a player; and
e. keeping the score of successfully executed commands.

2. The method of claim 1 wherein said tethers are attached between like limbs of adjacent players.

3. The method of claim 2 wherein said tethers distally bear a fabric attachment means with a coacting attachment connecting means adjacent each end, whereby the end of said tether may be looped about a limb of a player and secured to said tether by said connecting means.

4. The method of claim 1 wherein said step of randomly selecting and giving manipulation commands includes selecting one of a plurality of game cards each of which contains a single manipulation command.

5. The method of claim 1 wherein said step of randomly selecting and giving manipulation commands includes the steps of randomly selecting one of a plurality of game cards, each of which contains a single manipulation command, to provide a sequence of manipulation commands.

6. The method of claim 5 wherein said step of score keeping includes progressively advancing a marker along a preselected path on a game board.

7. The method of claim 6 wherein an increment of said progressive advance is made upon the successful completion of each given command.

8. The method of claim 7 wherein said game is ended upon the occurrence of any of the following:

a. failure of a player to execute a given command;
b. the forced release of a tether from a player's limb;
c. failure of any player to maintain a previously established contact;
d. any player falling to the ground; and
e. upon exhaustion of all said plurality of cards.

9. The method of claim 1 wherein said players are positioned in a circle.

10. The method of claim 1 wherein said tethers are attached to the arms of said players to interconnect the arms of each player to the immediately adjacent player.

11. The method of claim 10 wherein said tethers distally bear wrist cuffing means.

12. The method of claim 1 wherein said commands require a player to touch a point on another player and to maintain contact with such point throughout the remainder of the game.

13. The method of claim 1 wherein said tethers are from 18 to about 24 inches long.

14. The method of claim 1 wherein said wrist grasping means are fabric loop and hook attachment means carried on said tethers.

15. The method of claim 14 wherein each of said tethers distally carries a fabric loop attachment tabs and coacting fabric hook attachment pads located adjacent thereto.

16. The method of claim 14 wherein said tethers are attached between said players to interconnect the arms of each player to the immediately adjacent player.

17. The method of claim 16 wherein said tethers distally bear wrist cuffing means.

18. The method of claim 1 wherein each of said tethers distally carries buttons with button holes located adjacent thereto, permitting each end to be looped about a player's limb and secured to the tether, thereby grasping the players's limb.

19. A combination of playing elements for a game which comprise:

a. a plurality of tethers, which are from 10 to about 30 inches long, and each of which distally bear means for grasping the limbs of players of the game;
b. a plurality of game cards each of which contains a single manipulation command; and
c. score keeping means.

20. The combination of claim 19 wherein said tethers are from 18 to about 24 inches long.

21. The combination of claim 20 wherein said wrist grasping means are fabric loop and hook attachment means carried on said tethers.

22. The combination of claim 21 wherein each of said tethers distally carries a fabric loop attachment tabs and coacting fabric hook attachment pads located adjacent thereto.

23. The combinations of claim 19 wherein each of said tethers distally bears fabric attachment means with a coacting attachment connecting means adjacent each end, whereby each of the ends of said tether may be looped about a limb of a player and secured thereto.

24. The combination of claim 19 wherein each of said tethers distally carries buttons with button holes located adjacent thereto, permitting each end to be looped about a players's limb and secured to the tether, thereby grasping the player's limb.

25. The combination of claim 19 wherein said score keeping means comprises a game board with a path formed of a progressive array of squares, together with at least one game piece to be advanced progressively from square to square.

* * * * *